United States Patent [19]

Peppiatt

[11] Patent Number: 5,033,867

[45] Date of Patent: Jul. 23, 1991

[54] FLEXIBLE BAG WITH POURING SPOUT

[75] Inventor: Harry R. Peppiatt, Doylestown, Pa.

[73] Assignee: Paramount Packaging Corporation, Chalfont, Pa.

[21] Appl. No.: 463,483

[22] Filed: Jan. 11, 1990

[51] Int. Cl.[5] ..... B65D 33/06; B65D 33/36

[52] U.S. Cl. ..... 383/29; 383/50; 383/120; 383/906

[58] Field of Search ..... 333/29, 50, 90, 66, 333/904, 906, 120; 493/226; 53/413

[56] References Cited

U.S. PATENT DOCUMENTS

| | | | |
|---|---|---|---|
| 1,152,846 | 9/1915 | Ross | 383/906 X |
| 1,833,675 | 11/1931 | Geimer . | |
| 2,171,718 | 9/1939 | Vogt . | |
| 2,672,213 | 3/1954 | Cropley | 383/904 X |
| 2,740,577 | 4/1956 | Bauman | 383/50 X |
| 2,995,205 | 8/1961 | Cordell | 383/90 X |
| 2,998,340 | 8/1961 | Conway et al. | 383/906 X |
| 3,171,581 | 3/1965 | Kugler | 383/906 X |
| 3,190,531 | 6/1965 | Holmstrom . | |
| 3,195,801 | 7/1965 | Symons et al. | 383/50 X |
| 3,297,233 | 1/1967 | Meyerhoefer | 383/904 X |
| 3,350,859 | 11/1967 | Fesco | 383/904 X |
| 3,367,380 | 2/1968 | Dickey | 383/906 X |
| 3,419,258 | 12/1968 | Ritchie | 383/50 X |
| 3,935,993 | 2/1976 | Doyen et al. | 383/906 X |
| 4,454,979 | 6/1984 | Ikeda et al. . | |
| 4,672,688 | 6/1987 | Kalkipsakis . | |
| 4,877,336 | 10/1989 | Peppiatt | 383/8 |
| 4,881,825 | 11/1989 | Olesen | 383/906 |

FOREIGN PATENT DOCUMENTS

| | | | |
|---|---|---|---|
| 2642545 | 4/1977 | Fed. Rep. of Germany | 383/50 |
| 1246814 | 10/1960 | France | 383/50 |

*Primary Examiner*—Stephen Marcus
*Assistant Examiner*—Jes F. Pascua
*Attorney, Agent, or Firm*—Fitzpatrick, Cella, Harper & Scinto

[57] ABSTRACT

In one embodiment, a flexible bag comprises an inner bag for storing product having a top end region provided with a channel flap. The flap comprises a flexible pouring spout closed above by a folded portion of the inner bag and closed below by a seal. In another embodiment, a flexible bag comprises an inner bag for storing product having a top end region and a channel flap connected thereto. The channel flap comprises a flexible pouring spout. The channel flap and inner bag are provided with juxtaposed die cut openings which define a flow inlet for the pouring spout.

13 Claims, 7 Drawing Sheets

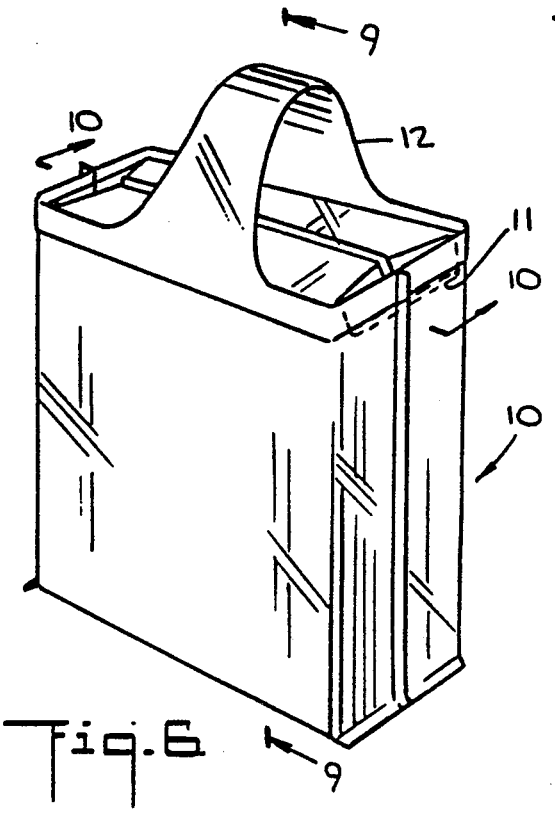
Fig. 6
Fig. 9.
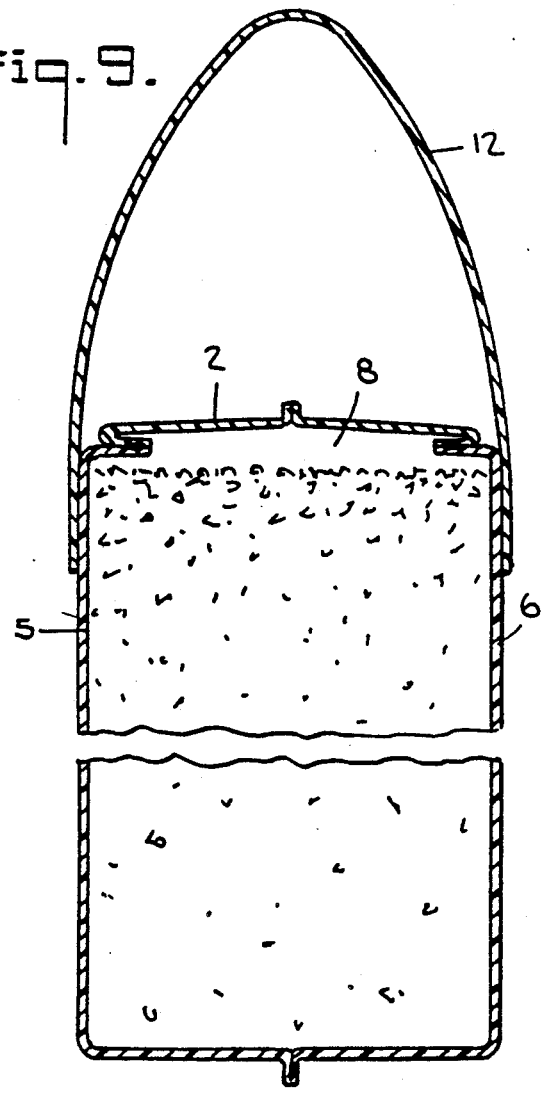
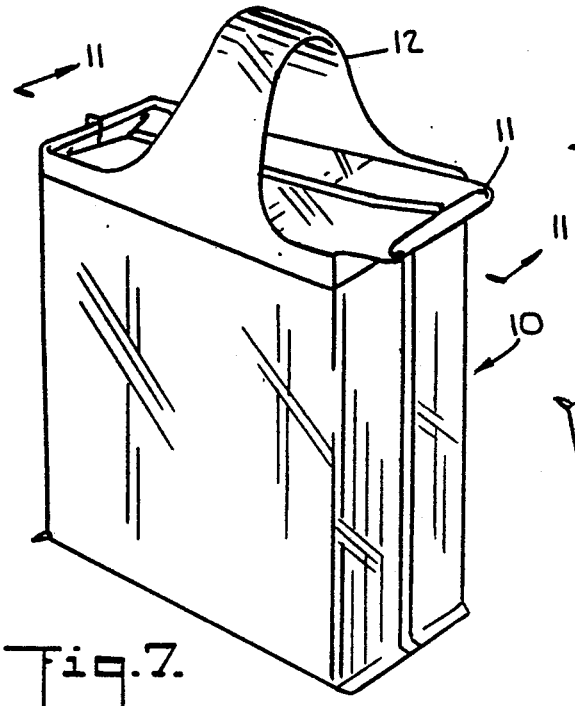
Fig. 7.
Fig. 8.
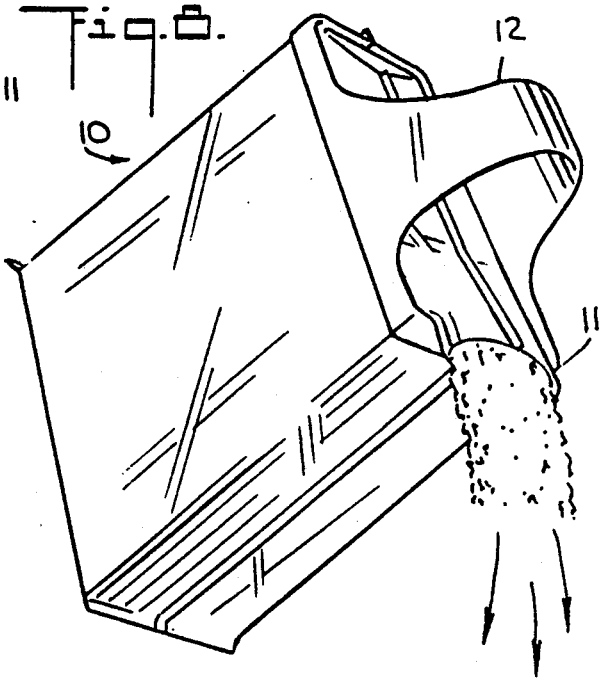

FLEXIBLE BAG WITH POURING SPOUT

BACKGROUND OF THE INVENTION

1. Field of the Invention

The present invention is directed to flexible packaging for a pourable product such as granular, powdered or liquid material. The invention is also directed to a flexible packaging having a pre-formed pouring spout that can be fabricated by a mass production technique.

2. Background of the Invention

Product in transit must be packaged so that the product is closed from the atmosphere. This is particularly true for hydrophilic products such as dry dog food, laundry detergent, cat litter, bird seed, etc. For pourable product, such as granular or powdered material, it is desirable that the packaging be provided with a structure for conveniently dispensing the material. It is also desirable for the packaging to be re-closed after use. Where the product is intended for the consumer market, it is desirable for the packaging to have a handle structure which permits the packaging, when filled, to be conveniently carried.

The problem solved by the present invention is that of providing a flexible packaging structure for storing a pourable product, including a structure for conveniently dispensing the product and a mass production technique for fabricating the packaging structure.

Another problem solved by the present invention is that of permitting the packaging to be secured after use.

For the purpose of illustrating the invention, there is shown in the drawings forms which are presently preferred; it being understood, however, that this invention is not limited to the precise arrangements and instrumentalities shown.

SUMMARY OF THE INVENTION

According to the present invention, a flexible bag with a preformed flexible pouring conduit comprises a flexible bag having flexible front and rear panels and a flexible gusset connecting the panels. The panels and gusset may be made, for example, from a single sheet of flexible plastic material by folding and sealing in manners disclosed in U.S. Pat. Nos. 4,252,269 and 4,573,203, which are incorporated herein by reference. In the bag of this invention the gusset has an opening, preferably in its central portion, and a conduit, preferably comprising flexible sheet material, is connected to the opening. The flexible conduit preferably also comprises an extended flexible pouring spout. In this invention the gusset and the conduit may be made from separate materials, joined together at the opening, or from the same sheet of flexible material, as will be explained below.

Bags of the present invention may have attached to themselves handles for convenience of carrying, covers over the conduit to protect it in transit, or may be incorporated into duplex bags with their advantages such as strength. Suitable handles may be, for example, of the kinds shown in U.S. Pat. Nos. 3,370,630, 4,252,269, and 4,573,203, incorporated herein by reference. Duplex bags of the kind disclosed in U.S. Pat. No. 4,877,336, incorporated herein by reference, may also be combined with the present invention.

Also according to the present invention, a flexible bag with a pouring conduit may be manufactured at a high speed by selecting a longitudinal sheet of flexible material, preferably of thermal plastic, cutting openings in the sheet at locations such that in later folding steps at least one opening will be in the central portion of a gusset of the bag. In the method of the invention, flexible conduits are connected to said openings. The sheet is then folded to create front and back panels and a gusset between said panels, preferably folding the conduits within the gusset. The folded sheet may then be separated into individual bags. For example, one may use methods shown in U.S. Pat. Nos. 4,252,269 and 4,573,203, referred to above. The method of the present invention may be used with additional steps to add covers, handles, and duplex bags using methods such as those shown in the U.S. patents mentioned above.

BRIEF DESCRIPTION OF THE DRAWINGS

FIG. 6 is a perspective of a bag of the invention with its spout tucked into a fold in the gusset adjacent an end panel.

FIG. 7 shows the bag of FIG. 6 with the spout untucked for pouring.

FIG. 8 shows the bag of FIGS. 6 and 7 being used to pour out its contents.

FIG. 9 is a cross-section at 9—9 in FIG. 6.

DETAILED DESCRIPTION OF THE PREFERRED EMBODIMENTS

This invention relates preferably to bags of the general type that may be made, for example, from a continuous sheet of polymeric plastic which is first folded roughly in half lengthwise to create front and back panels, and then folded inward lengthwise at the first fold, forming a gusset that connects the front and back panels. The folded sheet of plastic is then cut and sealed crosswise at intervals. When the bags are filled, they assume a roughly hexahedral shape. See, for example, the patents referred to above.

Figures 1, 2, 3, 4, 5:
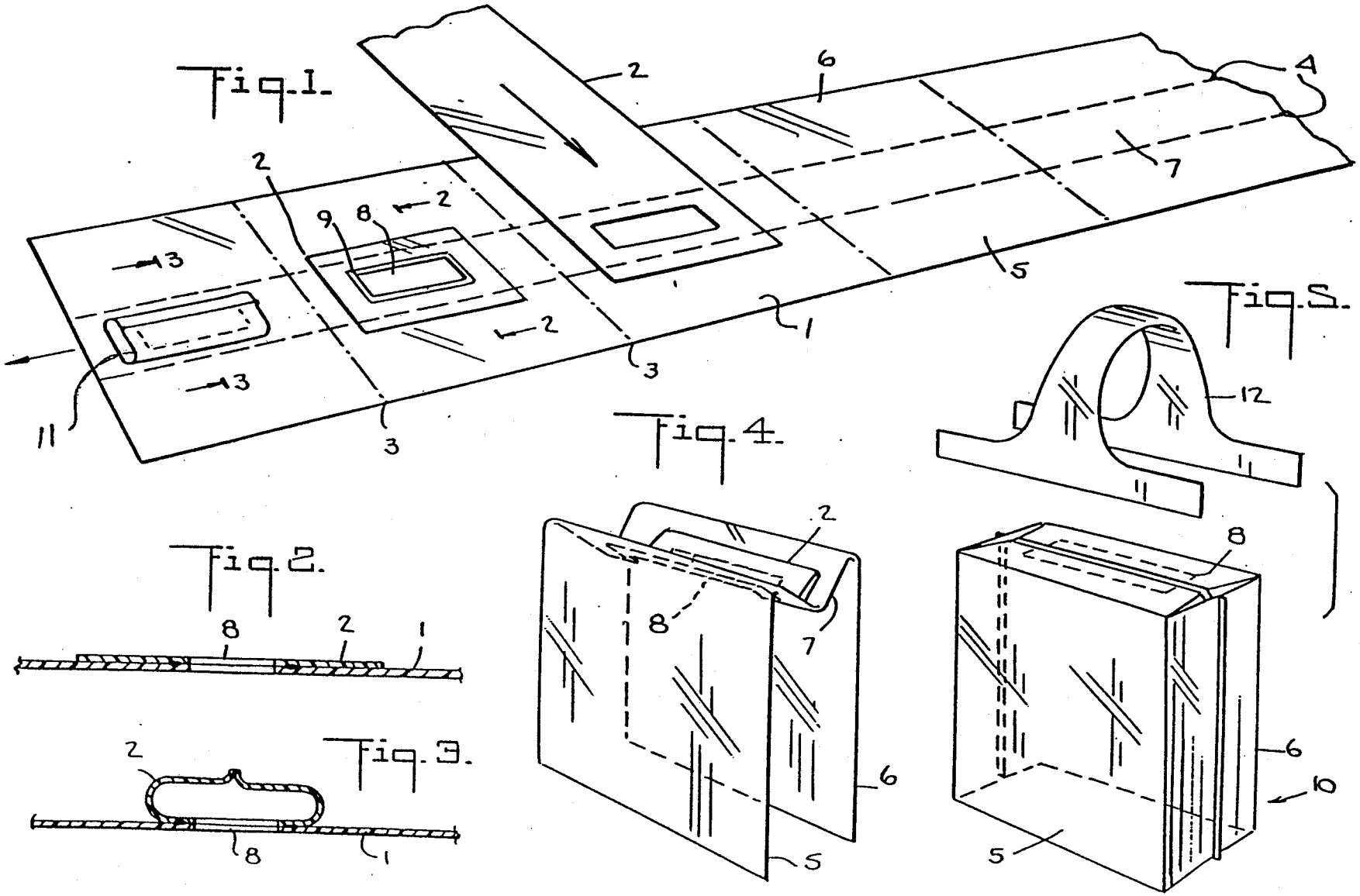
FIG. 1 is a perspective showing steps of a method of this invention.
FIG. 2 is a cross-section taken at 2—2 in FIG. 1.
FIG. 3 is a cross section taken at 3—3 in FIG. 1.
FIG. 4 shows a bag of the invention as it is partially formed.
FIG. 5 shows the addition of a handle to the bag of the invention.

Referring to the drawings, wherein like numerals indicate like elements, there is shown in FIG. 1 a sheet 1 of flexible plastic material which is moved in its longitudinal direction, as indicated by the arrow in FIG. 1. The imaginary lines 3 indicate where the sheet 1 will be cut to form individual bags, and the imaginary lines 4 indicate where the sheet 1 will be folded to make front panels 5 and rear panels 6 for bags of the invention. The front and rear panels are connected by gusset 7. Thus, as used herein, the word "connected" refers not only to a separate piece affixed to second, third or more separate pieces, but also when the context permits, "connected" refers to one integral piece having different portions that serve two, three, or more functions. For example, a handle may be made from the same piece of plastic sheet as front and rear panels, and in that sense the front and rear panels are connected to the handle.

As also shown in FIG. 1, a second sheet of flexible material 2 is led adjacent the first sheet 1. A portion of the sheet 2 is cut off and placed on sheet 1. The location and size of the portion of sheet 2 will depend on the features desired, as will become clear below. Preferably, it is placed closer to one cutting location line 3 than the other. This closer end becomes the extended outlet spout (or extended flexible pouring spout) for the pouring conduit. Its extended length permits the outlet to be directed for better pouring and to be tucked out of the way (in a depression in guesset 7 at the end of the bag) when not in use. The opposite end of the conduit preferably is closed and placed far enough from a cutting location 3 so that when the bag is filled, the unused portion of the conduit is out of the way or kept to a minimum. An opening 8 (or a through hole) is cut in sheet 2 and in the gusset portion of sheet 1, and sheet 2 and sheet 1 are sealed around that opening, as indicated by the area 9. This sealing may be done by thermal methods or by adhesives, as desired. The sheet 2 is then formed into a roughly tubular shape and its edges sealed together in any appropriate manner to form a conduit. One end of the conduit is preferably sealed, and the longer outlet end 11 (or outlet spout or extended outlet sprout) is left open to act as a conduit and spout for contents held within the bag when completed and filled.

When filled, the bag 10 may assume a roughly hexahedral shape, as shown in FIG. 5, with front portion 5 and rear portion 6. The outlet end 11 of the pouring conduit preferably extends beyond the sides of the bag when filled, and most preferably significantly beyond the sides. As shown in FIGS. 7 and 8, this extended outlet 11 thereby acts as a spout and permits the contents to be easily poured and directed with reduced tendency to spill or hit the sides of the bag. When not in use, the extended length of outlet spout 11 permits it to be tucked into a fold at one end of the gusset, as shown in FIG. 6. A handle 12 may be added of any suitable kind, such as those shown in U.S. Pat. No. 4,573,203.

Figure 10:
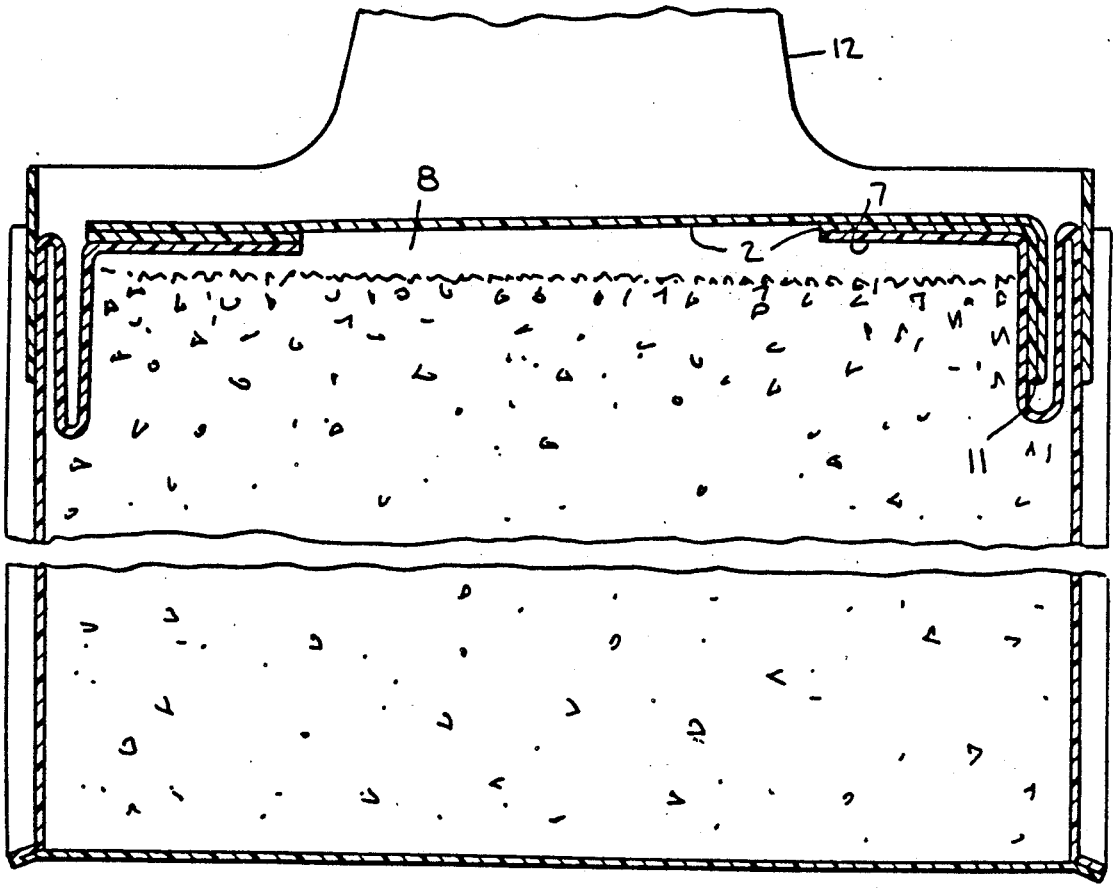
FIG. 10 is a cross-section at 10—10 in FIG. 6.
Figure 11:
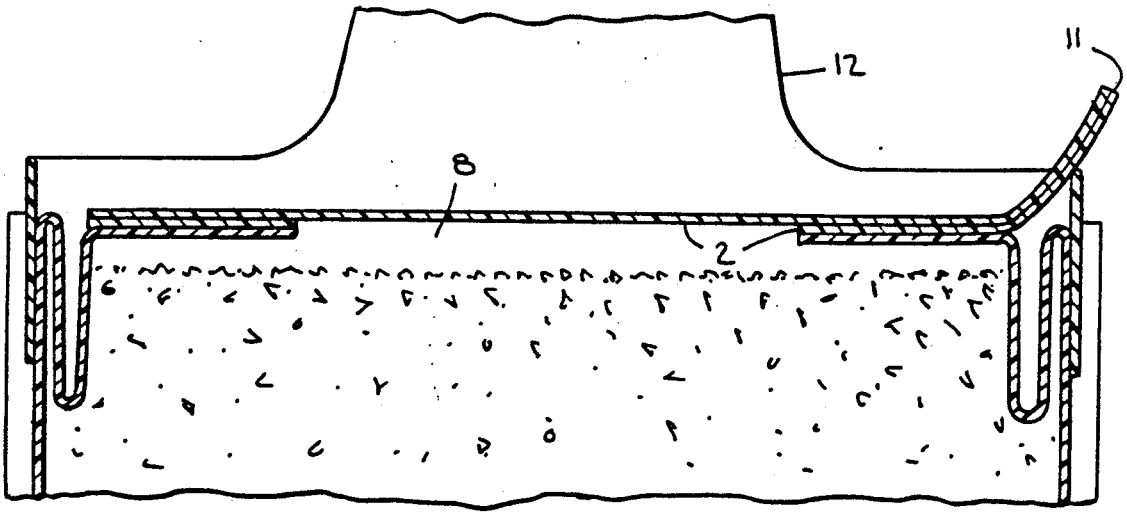
FIG. 11 is a cross-section taken in at 11—11 in FIG. 7.
Figure 13:
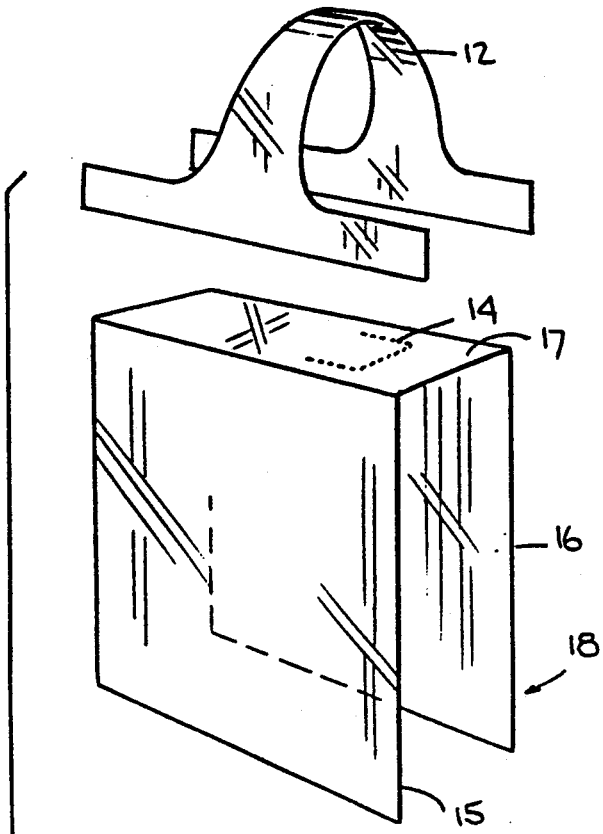
FIG. 13 is a perspective view of the bag of FIG. 12 assembled.
Figure 13:
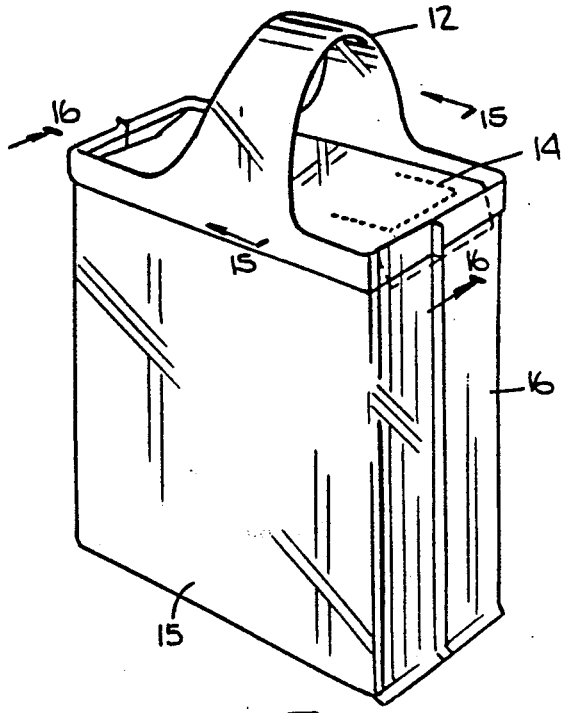

When one wishes to use the pouring conduit, the extended outlet spout 11 is untucked, as shown in FIG. 7, the bag tilted, and the contents permitted to flow outward, as shown in FIG. 8. A cross section view of the bag of FIG. 6 with the outlet 11 tucked out of the way in a depression in guesset 7 at the end of the bag is shown in FIG. 10, and a view with the outlet end ready for use is shown in FIG. 11.

Figure 12:
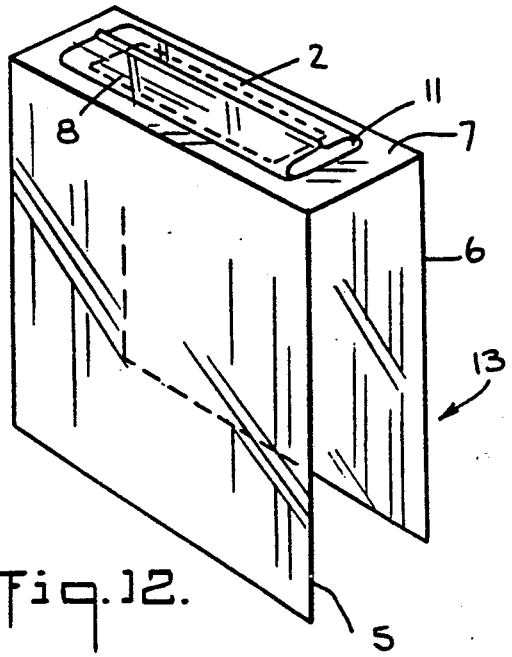
FIG. 12 shows a perspective, exploded view of a duplex bag of the invention.

If one wishes to completely cover the spout, one may use a duplex bag arrangement such as shown in FIG. 12, wherein the front and rear panels 5 and 6 and gusset 7 comprise an inner bag 13, which includes an opening 8 and a pouring conduit 2 with outlet 11. Front and rear panels 15 and 16 and gusset 17 comprise an outer bag 18 with perforations 14 in the gusset 17 outlining a flap 19. In this embodiment, the gusset 17 acts as a cover for the pouring conduit 2. Access is gained to the outlet 11 by opening the gusset 17, for example by perforations 14. The inner bag 13 stores product, and the outer bag 18 supports the inner bag. Handle 12 is line welded to the front and rear panels 15 and 16 of the outer bag. After the bag is filled, the front and rear panels 5 and 6 of inner bag 13 and the front and rear panels 15 and 16 of the outer bag 18 are folded and sealed in a conventional manner at a bottom seam at the squared off bottom end of the filled bag.

Preferably, inner bag 13 is a unitary piece of material having a gusseted top end 7. Outer bag 18 is also preferably a unitary piece of material having a gusseted top end 17 including a frangible portion 14. Loop handle 12 can then be grasped by the hand or slung over the user's forearm and the bag tilted to dispense product through the open outlet end 11 of the pouring conduit 2.

The frangible portion of the gusseted top end 17 of the outer bag may be defined by the characteristics of the outer bag material itself. That is, the frangible portion of the outer bag may be made of a material which can be conveniently severed or torn, either by hand or with the assistance of a sharp edged tool, with relatively little resistance. The frangible portion may also be defined by a pattern of perforations 14 which weaken the outer bag material. Any combination of the foregoing exemplary techniques, or equivalent techniques, may be employed in defining the frangible portion of gusset 17.

A margin at the bottom of rear panels, such as 6 and 16 in FIG. 12, may be provided with wicket holes.

Figure 14:
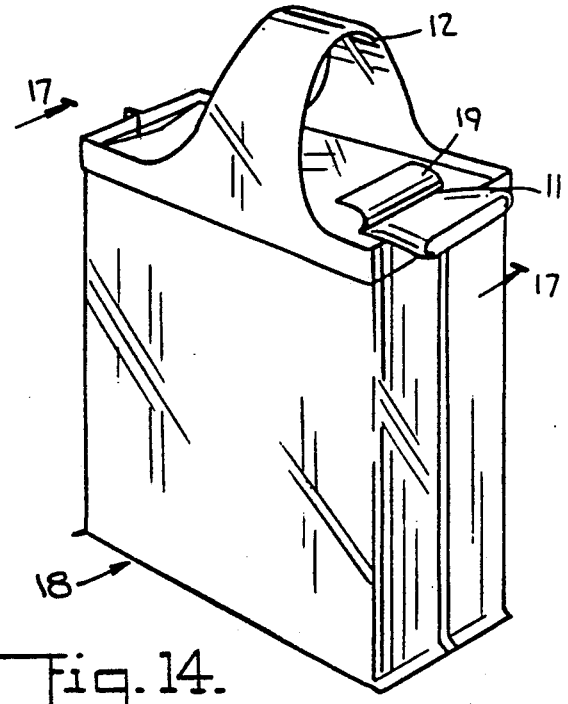
FIG. 14 is a perspective view of the bag of FIG. 13 with the spout ready for use.
Figure 15:
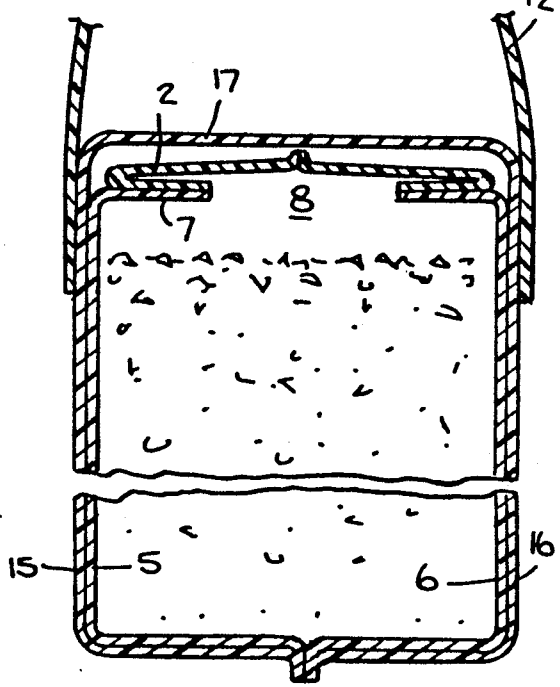
FIG. 15 is a section taken at 15—15 in FIG. 13.
Figure 16:
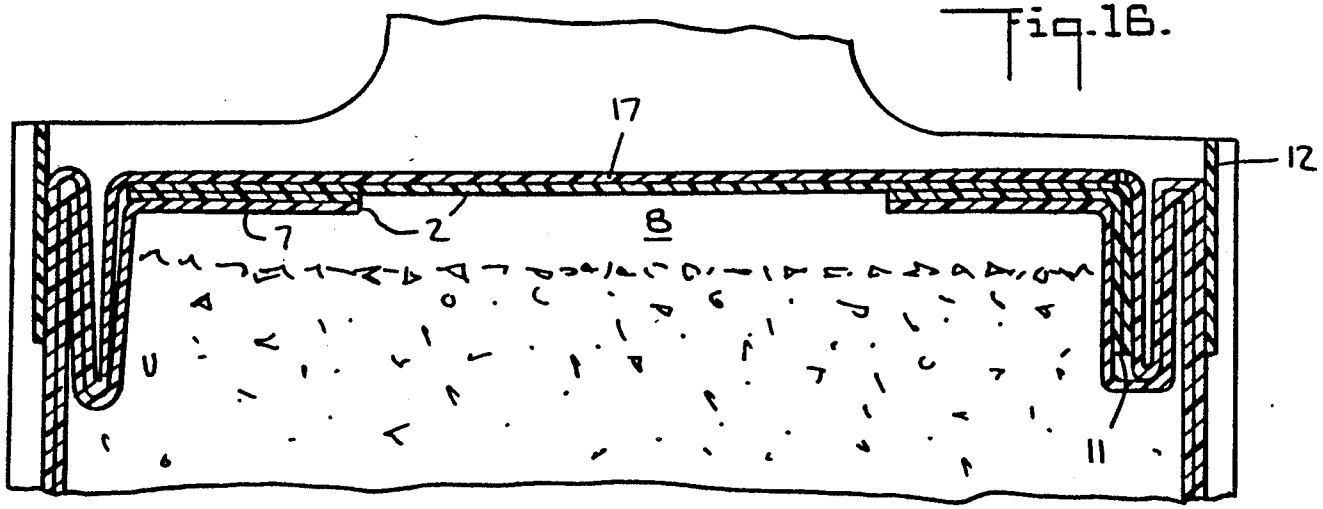
FIG. 16 is a cross-section taken at 16—16 in FIG. 13.
Figure 17:
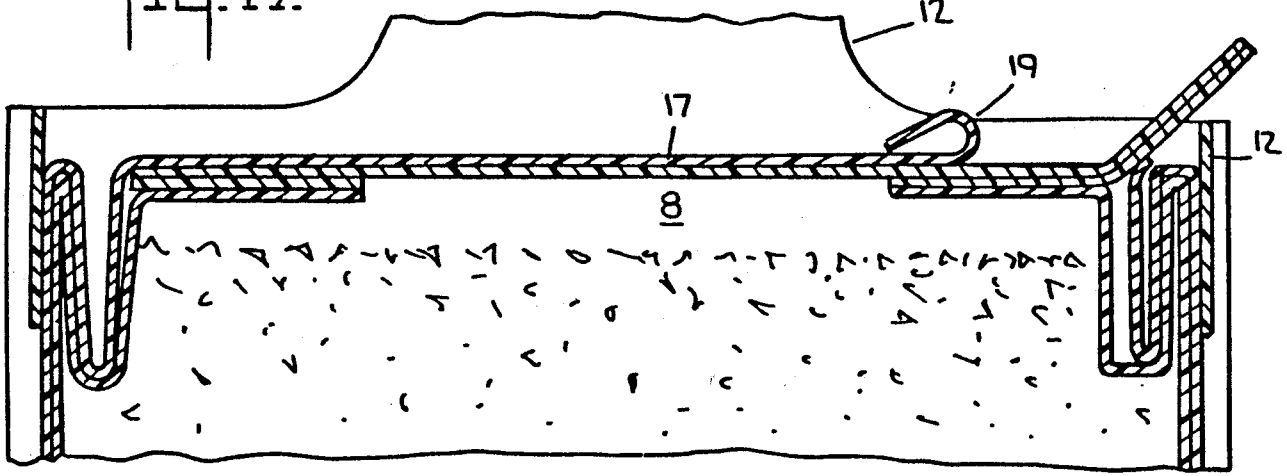
FIG. 17 is a cross-section taken at 17—17 in FIG. 14.

Overlapping inner and outer bags in FIG. 12 are assembled so they and their gussets 7 and 17 are formed generally into an "M"-shaped section. The combined webs are then cut and sealed (heat welded) at regular spaced intervals indicated by imaginary lines 3 in FIG. 1. The result is a bottom loadable top-gusseted duplex bag according to the present invention. When the bag is to be filled, it may be torn off its wickets and filled with pourable product such as granular or powdered material. Thereafter, the bottom end of the bag may be folded and sealed as shown in FIG. 14 to form a squared off bottom.

Figure 21:
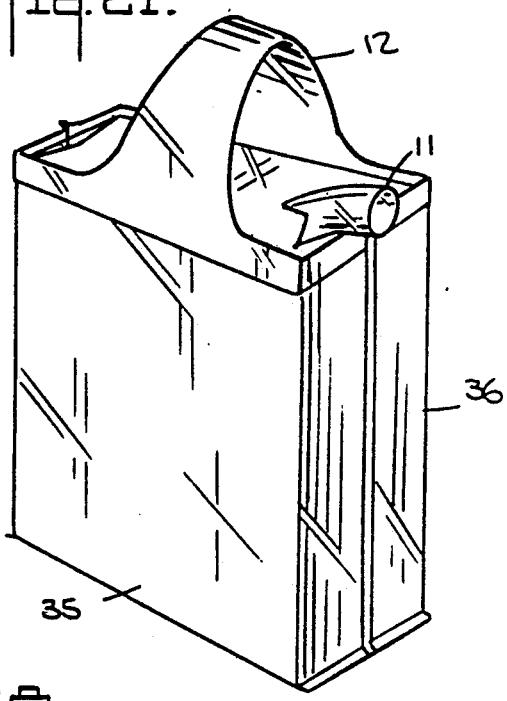
FIG. 21 is a perspective of the bag of FIG. 20 with its spout ready for use.
Figure 18:
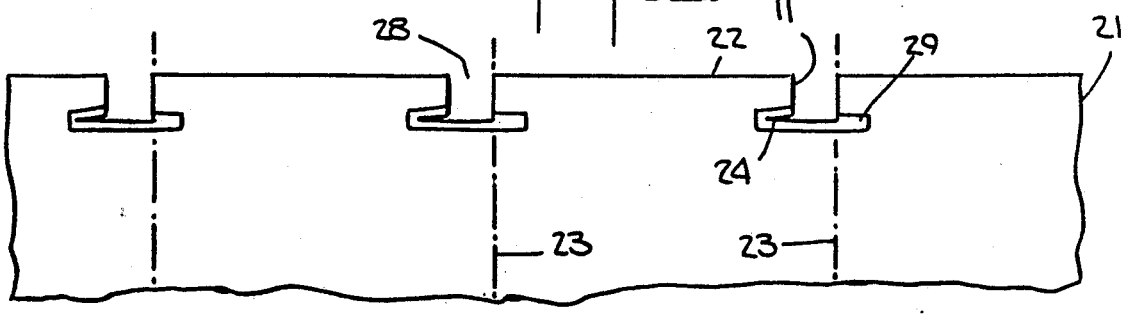
FIG. 18 shows a side view of a bag of the invention in its partially completed form.

FIG. 18 relates to a method of making the pouring conduit out of the very same plastic sheet as the gusset. In this method a sheet of plastic 21 has a conduit portion formed by putting a fold in sheet 21 to create a conduit portion 22. A portion of sheet 21 is cut out at 28 and an adjacent portion of sheet 21 is sealed to itself to form a sealed area 29. A portion of sealed area 29 is cut at slit 24 to create an outlet end 11 that can be directed and used as a pouring spout. The imaginary lines 23 indicate where the sheet will be cut, sealed and separated to make individual bags. Sealing on the line 23 closes one end of conduit 22, but leaves the outlet end 11 open. The bag and conduit of FIG. 18 may then be combined with a handle, or a handle and a covering bag, as shown in an exploded view in FIG. 19, and in assembled view in FIG. 21. In these FIGS. 25 and 26 represent front and rear panels of an inner bag, 27 the gusset of the inner bag, 22 the pouring conduit, 14 perforations and 2 the handle. The front and rear panels 35 and 36, the gusset 37 of the outer bag, and the handle 12 carry and cover the inner bag and the pouring conduit 22.

Figure 23:
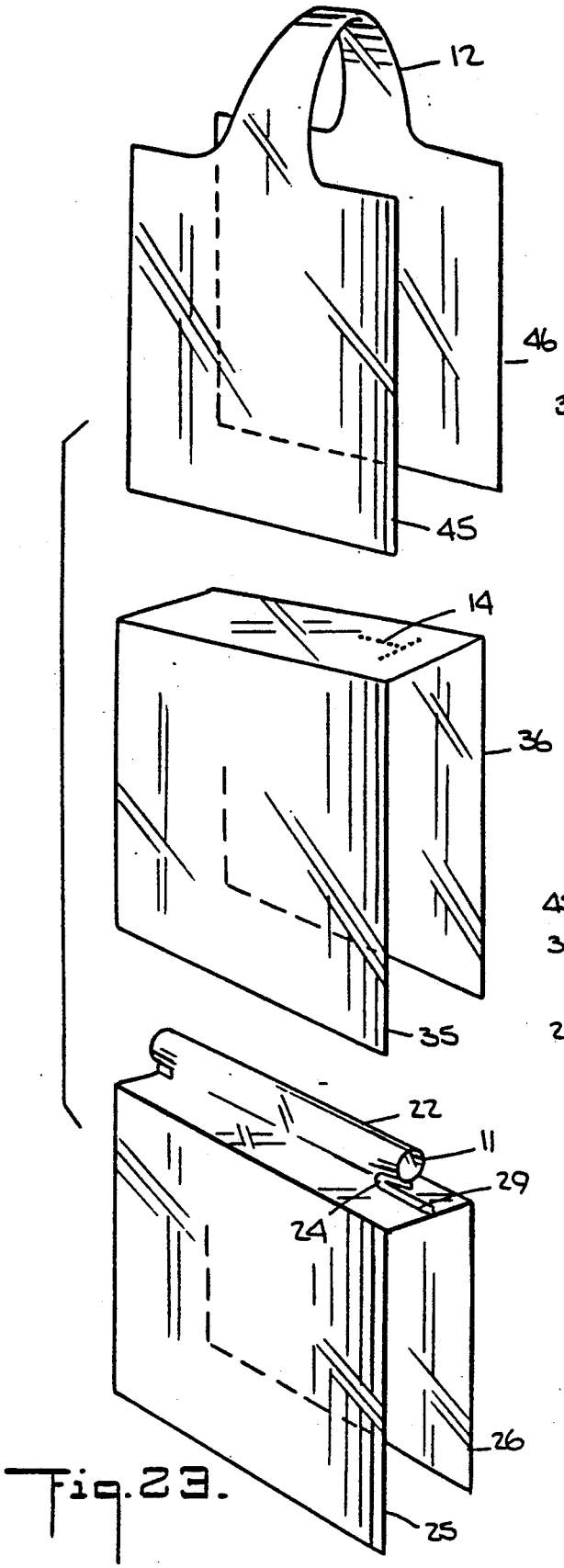
FIG. 23 is a perspective, exploded view of a triplex bag of the present invention.
Figure 22:
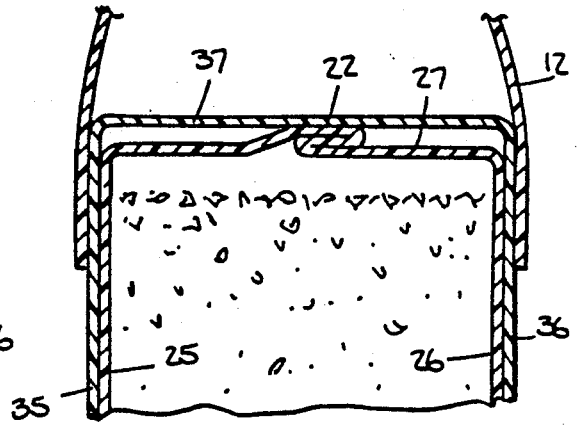
FIG. 22 is a cross-section taken at 22—22 in FIG. 20.
Figure 24:
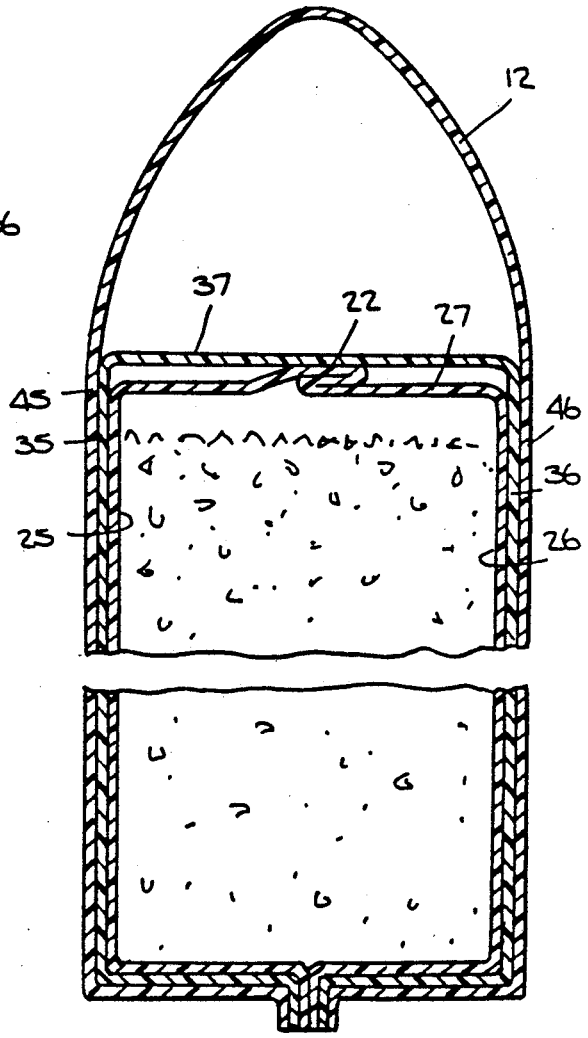
FIG. 24 is a cross section of the bag of FIG. 23 after assembly.

As shown in exploded view in FIG. 23 and in cross sectional view in FIG. 24, a triplex bag is possible with the present invention. In FIG. 23, the handle 12 extends down the sides of the bag as front and rear panels 45 and 46.

The embodiment of FIGS. 18 to 24, in which the pouring conduit is fabricated from the same sheet of plastic as the front and back panels and the gusset, may be less expensive to manufacture, but the embodiments of FIGS. 1 to 17 have as one advantage that their contents flow out more uniformly and freely. When pouring using the embodiments of FIGS. 1 to 17, distortions to and bottle necks in the conduit are reduced, and the conduit tends to stay open.

Figure 19:
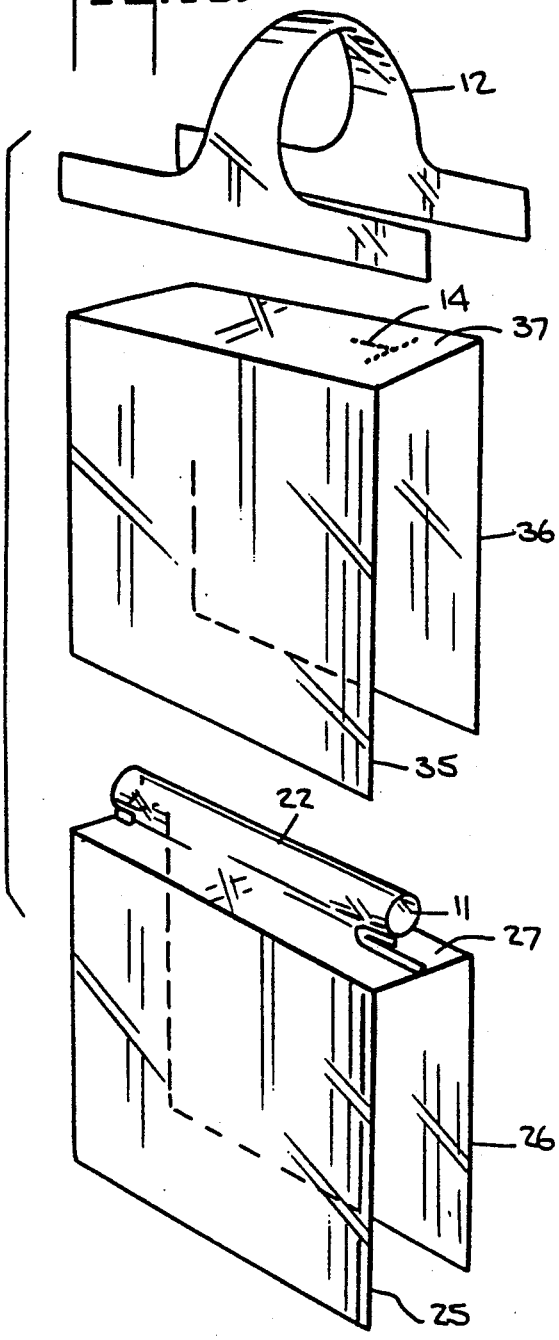
FIG. 19 is an exploded, perspective view of one embodiment of the present invention.
Figure 20:
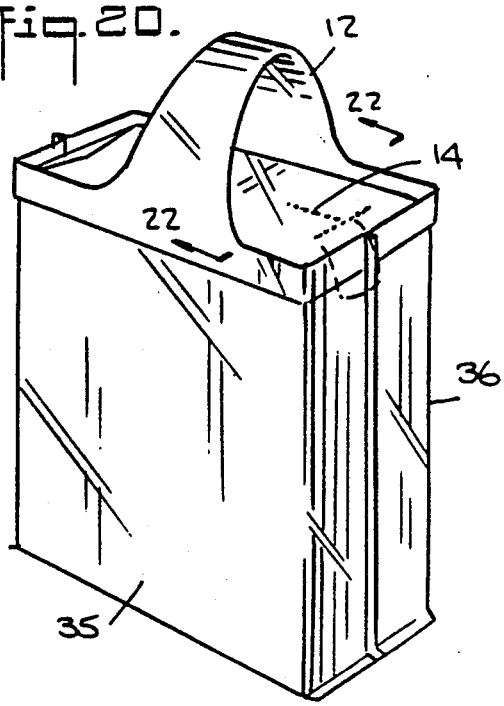
FIG. 20 is a perspective, assembled view of the bag of FIG. 19.

As shown in FIG. 19, an outer bag gusset 37 may be provided with a "T"-shaped pattern of perforations 14 whereby the gusset can be broken along the perforations to define a pair of corner flaps which can be folded back to form a break or opening through which the outlet 11 can be drawn. Other shapes or patterns of perforations may also be used. Alternatively, an opening (not shown) may be pre-formed in the outer gusset, by die cutting, by creation of a recloseable opening having mating male and female grooves, or the like, during fabrication of the bag. The opening may be left exposed or it may be covered by an adhesive backed material which may be peeled away by the user to expose the opening. In either case, the opening is sized so that the pouring spout can be drawn through the opening to dispense product. As a further alternative, the outer gusset may be made of a frangible material, and printed directions on the gusset may indicate where to break through the gusset to gain access to the spout.

Once the desired amount of product has been dispensed through the pouring spout, the pouring spout can be tucked back through the opening at 14, any die cut opening, or any other opening, into a non-use position tucked underneath the outer bag gusset. In the non-use position, the pouring spout may be folded over, so that the open end 11 of the pouring spout flattens and closes.

The provision of the loop handle 12 in each embodiment described heretofore, wherein the handle flanges completely encircle the bag, enhances the load bearing capacity of the bag and facilitates carrying of the bag by the user as described in U.S. Pat. No. 4,573,203. However, the invention does not require that the handle have flanges which completely encircle the bag or any flange at all.

Although the invention has been described in terms of a pre-formed pouring spout having an open outlet end, the pouring spout may also be pre-sealed at its outlet and opened subsequently, by tearing, severing or the like, prior to use. The outlet end portion of the pouring spout may be provided with perforations, or may otherwise be weakened, for facilitating breaking of the spout material to form the outlet end opening through which the bag contents may ultimately be dispensed Although the invention has been described inter alia in terms of inner and outer bags and duplex or triplex bag structures fabricated from webs of flexible thermoplastic material, it should be understood that the web material may be laminated or not without exceeding the scope of invention. For example, the inner bag or the outer or outermost bag of any of the embodiments can be a laminate formed by using a Saran (trademark) adhesive or coating which inhibits the passage of moisture through the laminate towards the stored product.

The present invention may be embodied in other specific forms without departing from the spirit or essential attributes thereof and, accordingly, reference should be made to the appended claims, rather than to the foregoing specification, as indicating the scope of the invention.

What is claimed:

1. A flexible bag with a preformed pouring conduit spout, comprising:

a flexible bag comprising front and rear flexible panels and a flexible guesset connecting said flexible panels, said gusset having a through hole in a portion thereof and a pouring conduit connected to said through hole, said pouring conduit having a sealed end and an open end for communicating with an interior of the bag.

2. A flexible bag according to claim 1 wherein said pouring conduit comprises a tubular shaped structure one end of which is sealed and the other end of which is open, and wherein said tubular shaped pouring conduit has a hole in a mid-portion thereof for communicating with the interior of the bag.

3. The flexible bag of claim 1 in which the opening is in a central portion of the gusset.

4. The flexible bag of claim 1 in which said conduit comprises flexible plastic sheet material and an extended flexible pouring spout.

5. The flexible bag of claim 1 in which the gusset and the conduit comprise separate materials joined at the hole in the gusset.

6. The flexible bag of claim 1 in which the gusset and the conduit comprise a single sheet of flexible material.

7. The flexible bag of claim 1 in which a handle is connected between the front and rear panels.

8. The flexible bag of claim 1 which comprises a layer of material extending between the front and rear panels and covering the gusset and the conduit.

9. A duplex bag comprising:

a flexible bag comprising front and rear flexible panels and a flexible gusset connecting said flexible panels at a top of said bag, said gusset comprising an opening in a portion thereof and a pouring conduit connected to said opening an outer bag comprising front and rear panels and a connecting gusset all placed outside said flexible bag, said connecting gusset covering at least a portion of said conduit.

10. The flexible bag of claim 8, wherein said pouring conduit includes a sealed end and an open end for communication with an interior of the bag.

11. A flexible bag according to claim 9 wherein said pouring conduit comprises a tubular shaped structure one end of which is sealed and the other end of which is open, and wherein said tubular shaped pouring conduit has a hole in a mid-portion thereof for communicating with the interior of the bag.

12. A flexible plastic bag comprising:

front and rear flexible panels;

a flexible gusset connecting said flexible front and rear panels, said gusset having a hole therein providing communication with an interior of the bag; and a pouring conduit connected to said gusset to provide communication to the bag interior through said opening, the pouring conduit having a sealed end and an open end for communicating with the interior of the bag.

13. A flexible bag according to claim 12 wherein said pouring conduit comprises a tubular shaped structure one end of which is sealed and the other end of which is open, and wherein said tubular shaped pouring conduit has a hole in a mid-portion thereof for communicating with the interior of the bag.

* * * * *

UNITED STATES PATENT AND TRADEMARK OFFICE

CERTIFICATE OF CORRECTION

PATENT NO. : 5,033,867

DATED : July 23, 1991

INVENTOR(S) : Harry R. Peppiatt

It is certified that error appears in the above-identified patent and that said Letters Patent is hereby corrected as shown below:

COLUMN 3:

Line 30, "guesset 7" should read --gusset 7--.
Line 64, "guesset 7" should read --gusset 7--.

COLUMN 4:

Line 67, "2" should read --12--.

COLUMN 6:

Line 14, "guesset" should read --gusset--.
Line 52, "claim 8," should read --claim 9,--.

Signed and Sealed this

Sixth Day of April, 1993

*Attest:*

STEPHEN G. KUNIN

*Attesting Officer*

*Acting Commissioner of Patents and Trademarks*